US009495854B2

(12) United States Patent
Sun et al.

(10) Patent No.: US 9,495,854 B2
(45) Date of Patent: Nov. 15, 2016

(54) MONITORING SYSTEM

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Zong-Yuan Sun, New Taipei (TW); Da-Hua Xiao, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/642,057

(22) Filed: Mar. 9, 2015

(65) Prior Publication Data

US 2016/0110974 A1 Apr. 21, 2016

(30) Foreign Application Priority Data

Oct. 21, 2014 (CN) ..... 2014 1 0561138

(51) Int. Cl.
*G08B 13/14* (2006.01)
*G08B 13/24* (2006.01)

(52) U.S. Cl.
CPC ..... *G08B 13/248* (2013.01); *G08B 13/2417* (2013.01)

(58) Field of Classification Search
CPC ..... G06Q 20/32; G06Q 20/3278; G06Q 20/203; G08B 13/2402; G08B 13/2417; G08B 13/246; G08B 13/248
USPC ..... 340/572.1, 572.7, 10.1, 555–557, 567, 340/539.13, 573.4; 235/385, 492; 705/22, 705/28
See application file for complete search history.

(56) References Cited

U.S. PATENT DOCUMENTS 4,471,343 A * 9/1984 Lemelson ..... G08B 25/008 307/10.5
5,825,291 A * 10/1998 Platt ..... H01Q 7/04 340/571
5,914,655 A * 6/1999 Clifton ..... G08B 29/186 340/506
6,980,100 B1 * 12/2005 Hammond ..... G08B 13/2417 340/10.1
8,258,956 B1 * 9/2012 Kuzma ..... G06Q 10/087 235/375
2004/0143505 A1 * 7/2004 Kovach ..... G06Q 10/087 705/23
2005/0035862 A1 * 2/2005 Wildman ..... A61B 5/1113 340/573.1
2006/0175402 A1 * 8/2006 Maitin ..... G06Q 20/20 235/383
2008/0024304 A1 * 1/2008 Bergman ..... G06K 7/10316 340/572.7
2008/0036687 A1 * 2/2008 Bergman ..... H01Q 1/40 343/895
2008/0061962 A1 * 3/2008 Campman ..... G07C 9/00111 340/539.13

* cited by examiner

*Primary Examiner* — Thomas Mullen
(74) *Attorney, Agent, or Firm* — Zhigang Ma

(57) ABSTRACT

A monitoring system includes a radio frequency identification (RFID) reader, an alarming unit, and a controlling unit. The RFID reader is buried in a predetermined area and reads identification information of an item. The controlling unit is coupled between the RFID reader and the alarming unit, the controlling unit receives the identification information from RFID reader and controls the alarming unit according to the identification information.

11 Claims, 2 Drawing Sheets

MONITORING SYSTEM

FIELD

The subject matter generally relates to items monitoring systems, and particularly relates to a monitoring system employing a radio frequency identification (RFID) device.

BACKGROUND

Personnel monitoring systems are widely used by supervisory institutions, such as hospitals, supermarkets, prisons, or jails. Commonly, such systems employ a video surveillance device, such as a closed-circuit television (CCTV). However, the video surveillance device may be damaged (e.g., human damage and physical damage).

BRIEF DESCRIPTION OF THE DRAWINGS

Implementations of the present technology will now be described, by way of example only, with reference to the attached figure.

DETAILED DESCRIPTION

Figure 1:
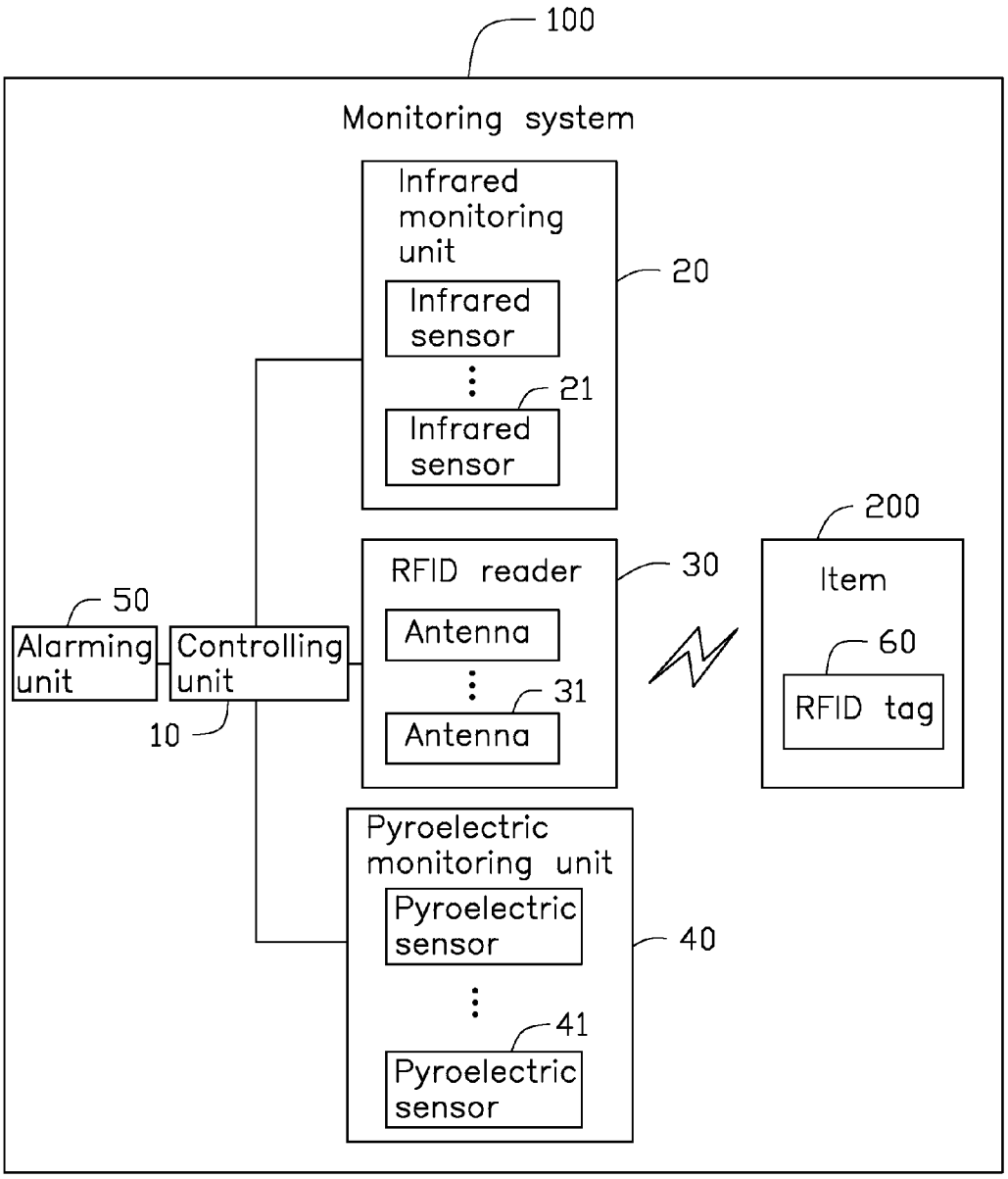
FIG. 1 is a block diagram of a monitoring system, according to an exemplary embodiment.

Numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawing is not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a monitoring system.

Figure 2:
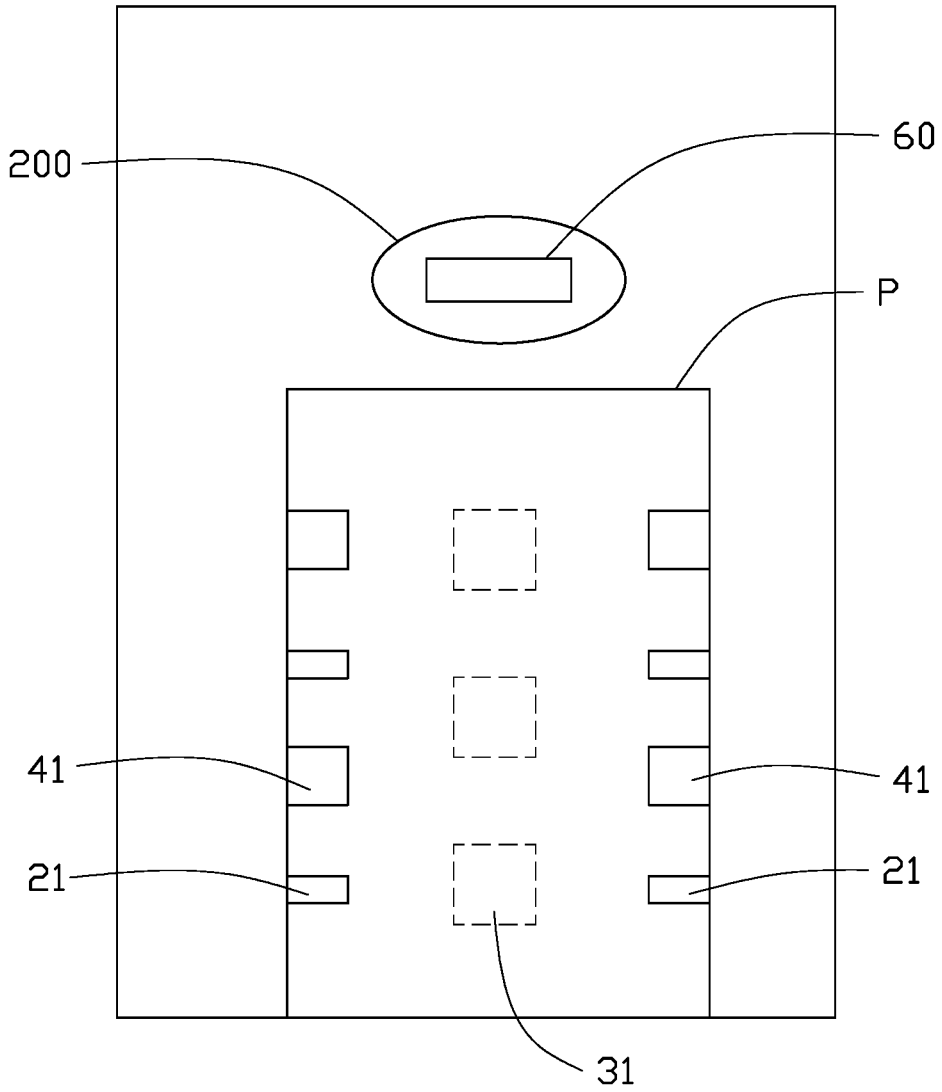
FIG. 2 is a diagrammatic view of the monitoring system of FIG. 1.

FIG. 1 illustrates an embodiment of a monitoring system 100, according to an exemplary embodiment. The monitoring system 100 can be employed by supervisory institutions, such as hospitals, supermarkets, prisons, or jails. Referring to FIG. 2, in at least one embodiment, the monitoring system 100 can be located at a predetermined area P (e.g., an exit) of the supervisory institutions to monitor items 200, such as luxury goods, confidential files, or prisoners, for example.

The monitoring system 100 includes a controlling unit 10, an infrared monitoring unit 20, a radio frequency identification (RFID) reader 30, a pyroelectric monitoring unit 40, an alarming unit 50, and an RFID tag 60. The controlling unit 10 is electronically coupled to the infrared monitoring unit 20, the RFID reader 30, the pyroelectric monitoring unit 40, an the alarming unit 50. The RFID tag 60 is attached on the items 200 and communicates with the RFID reader 30.

The controlling unit 10 can be a personal computer or a server. The controlling unit 10 is configured to activate (e.g., turn on) the infrared monitoring unit 20, the RFID reader 30, and the pyroelectric monitoring unit 40. In addition, the controlling unit 10 includes a screen (not shown) to facilitate displaying, storing, and acquiring data output from the infrared monitoring unit 20, the RFID reader 30, and the pyroelectric monitoring unit 40. Further, the alarming unit 50 is directed by the controlling unit 10 to trigger alarming signals in response to the data received from the infrared monitoring unit 20, the RFID reader 30, and the pyroelectric monitoring unit 40. In at least one embodiment, the alarming unit 50 can be a buzzer or a light emitting diode (LED).

The infrared monitoring unit 20 includes a plurality of infrared sensors 21. In at least one embodiment, the plurality of infrared sensors 21 are disposed on two opposite sides of the predetermined area P. The plurality of infrared sensors 21 are configured to send infrared signals and receive infrared signals reflected by the items 200, thereby detecting the items 200 accordingly. In detail, when the items 200 pass through the predetermined area P and are detected by the plurality of infrared sensors 21, the plurality of infrared sensors 21 output first monitoring data, and then the plurality of infrared sensors 21 transmit the first monitoring data to the controlling unit 10.

The RFID reader 30 includes at least one antenna 31 for communicating with the RFID tag 60. In at least one embodiment, the antenna 31 is an ultra high frequency (UHF) antenna which can operate at about 868 MHz to about 915 MHz. The antenna 31 is buried in the predetermined area P, and a radiation range of the antenna 31 substantially covers the predetermined area P. In detail, the least one antenna 31 can employ a power division technology to ensure that the RFID tag 60 located outside of the radiation range of the antenna 31 will not be read by the antenna 31. Optionally, the RFID tag 60 can be a UHF tag, and pre-stores identification information (e.g., a name) of the items 200. When the RFID tag 60 enters the predetermined area P, the antenna 31 reads the identification information from the RFID tag 60, and then transmits the identification information to the controlling unit 10.

The pyroelectric monitoring unit 40 includes a plurality of pyroelectric sensors 41. In at least one embodiment, the plurality of pyroelectric sensors 41 are disposed on the two opposite sides of the predetermined area P. The plurality of pyroelectric sensors 41 are configured to detect thermal radiation of a person, an animal, or other items 200 which has a constant temperature. When the items 200 pass through the predetermined area P and are detected by the plurality of pyroelectric sensors 41, the plurality of pyroelectric sensors 41 output second monitoring data, and then the plurality of pyroelectric sensors 41 transmit the second monitoring data to the controlling unit 10.

In summary, the monitoring system 100 includes the RFID reader 30, and the RFID reader 30 is buried in the predetermined area P. Thus, the monitoring system 100 is concealed and consequently cannot be damaged. In addition, both the infrared monitoring unit 20 and the pyroelectric monitoring unit 40 are further incorporated into the monitoring system 100 to improve an accuracy of the monitoring system 100.

The embodiments shown and described above are only examples. Many details are often found in the art such as the other features of the monitoring system. Therefore, many such details are neither shown nor described. Even though numerous characteristics and advantages of the present technology have been set forth in the foregoing description, together with details of the structure and function of the present disclosure, the disclosure is illustrative only, and changes can be made in the details, especially in matters of shape, size and arrangement of the parts within the principles of the present disclosure up to, and including the full extent established by the broad general meaning of the terms used in the claims. It will therefore be appreciated that the embodiments described above can be modified within the scope of the claims.

What is claimed is:

1. A monitoring system for monitoring an item in a predetermined area, the monitoring system in communication with a radio frequency identification (RFID) tag attached to the item, the RFID tag storing identification information of the item, the monitoring system comprising:

a RFID reader concealed and configured to read identification information from the RFID tag;

an infrared monitoring unit comprising a plurality of infrared sensors for sending infrared signals and receiving infrared signals reflected by the item;

an alarming unit configured to output an alarming signal; and a controlling unit coupled between the RFID reader and the alarming unit, the controlling unit configured to receive the identification information from the RFID reader and control the alarming unit according to the identification information.

2. The monitoring system as claimed in claim 1, wherein the RFID reader comprises at least one antenna communicating with the RFID tag, and a radiation range of the at least one antenna substantially covers the predetermined area.

3. The monitoring system as claimed in claim 2, wherein the at least one antenna is an ultra high frequency (UHF) antenna.

4. The monitoring system as claimed in claim 1, wherein when the item passes through the predetermined area and is detected by the plurality of infrared sensors, the plurality of infrared sensors output first monitoring data and transmit the first monitoring data to the controlling unit.

5. The monitoring system as claimed in claim 1, further comprising a pyroelectric monitoring unit, wherein the pyroelectric monitoring unit comprises a plurality of pyroelectric sensors for detecting thermal radiation of the item.

6. The monitoring system as claimed in claim 5, wherein when the item passes through the predetermined area and is detected by the plurality of pyroelectric sensors, the plurality of pyroelectric sensors output second monitoring data and transmit the second monitoring data to the controlling unit.

7. A monitoring system for monitoring an item in a predetermined area, the monitoring system in communication with a radio frequency identification (RFID) tag attached to the item, the RFID tag storing identification information of the item, the monitoring system comprising:

a RFID reader reading identification information from the RFID tag;

an infrared monitoring unit sending infrared signals and receiving infrared signals reflected by the item;

a pyroelectric monitoring unit detecting thermal radiation of the item;

an alarming unit outputting an alarming signal; and a controlling unit coupled to the RFID reader, the infrared monitoring unit, the pyroelectric monitoring unit, and the alarming unit;

wherein the RFID reader transmits the identification information to the controlling unit, the infrared monitoring unit transmits first monitoring data to the controlling unit, the pyroelectric monitoring unit transmits second monitoring data to the controlling unit, and the controlling unit controls the alarming unit according to at least one of the identification information, the first monitoring data, and the second monitoring data.

8. The monitoring system as claimed in claim 7, wherein the RFID reader comprises at least one antenna communicating with the RFID tag, the at least one antenna is buried in the predetermined area, and a radiation range of the antenna substantially covers the predetermined area.

9. The monitoring system as claimed in claim 8, wherein the at least one antenna is an ultra high frequency (UHF) antenna.

10. The monitoring system as claimed in claim 7, wherein the infrared monitoring unit comprises a plurality of infrared sensors disposed on two opposite sides of the predetermined area.

11. The monitoring system as claimed in claim 7, wherein the pyroelectric monitoring unit comprises a plurality of pyroelectric sensors disposed on two opposite sides of the predetermined area.

* * * * *